United States Patent [19]

Thornthwaite

[11] Patent Number: 4,764,092

[45] Date of Patent: Aug. 16, 1988

[54] LIQUID FUEL INJECTION PUMP

[75] Inventor: Ian R. Thornthwaite, Gillingham, England

[73] Assignee: Lucas Industries Public Limited Company, Birmingham, England

[21] Appl. No.: 44,516

[22] Filed: Apr. 30, 1987

[30] Foreign Application Priority Data

May 13, 1986 [GB] United Kingdom ..... 8611687

[51] Int. Cl.[4] ..... F04B 29/00; F02M 41/14

[52] U.S. Cl. ..... 417/462; 123/179 L; 123/450

[58] Field of Search ..... 417/462; 123/179 L, 123/450

[56] References Cited

U.S. PATENT DOCUMENTS

| | | | |
|---|---|---|---|
| 4,310,291 | 1/1982 | Green | 417/462 |
| 4,381,182 | 4/1983 | Broadwith | 417/462 |
| 4,393,844 | 7/1983 | Skinner | 417/462 |
| 4,406,264 | 9/1983 | Mowbray | 417/462 |
| 4,446,835 | 5/1984 | Mowbray | 123/179 L |
| 4,625,694 | 12/1986 | Adey | 417/462 |
| 4,652,220 | 5/1987 | Mowbray | 417/462 |

FOREIGN PATENT DOCUMENTS

| | | | |
|---|---|---|---|
| 2037365B | 7/1980 | United Kingdom | 417/462 |

*Primary Examiner*—William L. Freeh

*Attorney, Agent, or Firm*—Balogh, Osann, Kramer, Dvorak, Genova & Traub

[57] ABSTRACT

A liquid fuel injection pump of the rotary distributor type has a first groove on the distributor member for registration with fuel supply ports and a second groove for registration with outlet ports. The grooves are connected to the plunger bore and as the distributor member rotates fuel is supplied to the bore through the first groove and delivered to an outlet through the second groove. The distributor member is axially movable to control the quantity of fuel delivered and in the excess fuel position the second groove is arranged to register with a vent port during the initial period of registration of the first groove with an inlet port. This allows air to be purged from the passage and bore.

3 Claims, 1 Drawing Sheet

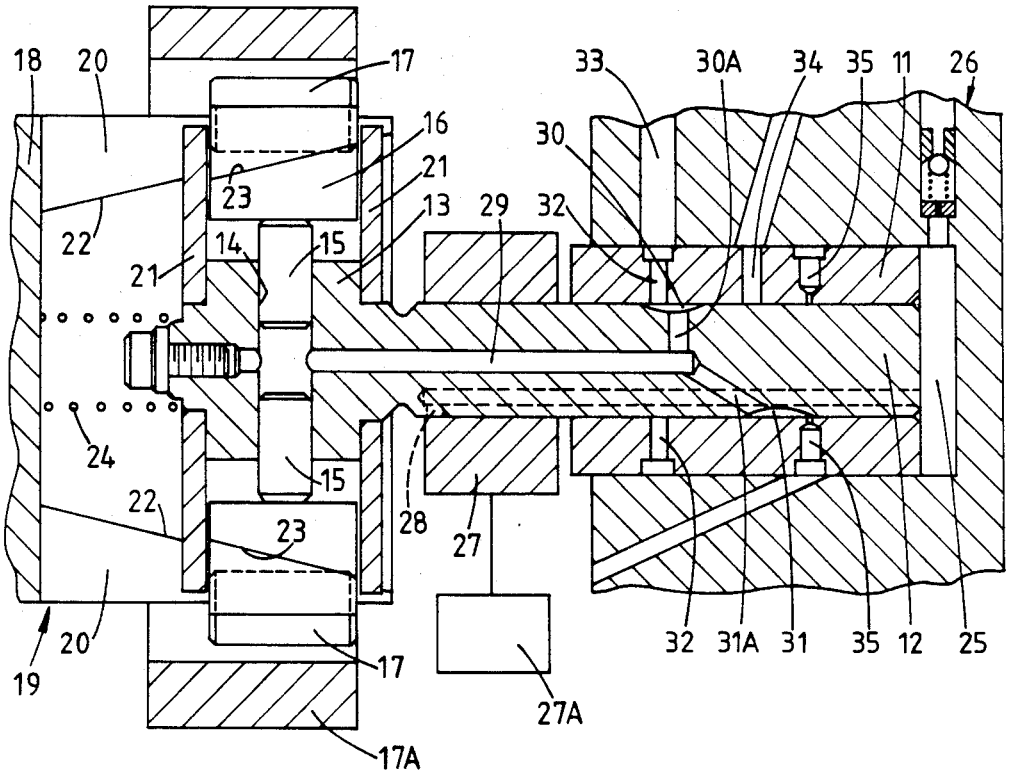
18
20
17
16
21
23
22
13
29
32
33
30A
34
35
11
26
30
14
15
21
24
15
22
23
28
27
20
19
17
17A
27A
32
31A
31
35
12
25

LIQUID FUEL INJECTION PUMP

This invention relates to a liquid fuel injection pump of the kind comprising a body part, a rotary distributor member mounted in the body part and axially movable therein, a bore formed in the distributor member and a pumping plunger therein, cam means for imparting inward movement to the pumping plunger as the distributor member rotates, a delivery groove communicating with said bore, said delivery groove being formed in the periphery of the distributor member and being arranged to register in turn with outlet ports formed in the body part during successive delivery strokes of the pumping plunger, means for feeding fuel to said bore to effect outward movement of the pumping plunger and stop means for limiting the outward movement of the pumping plunger, said stop means being arranged so that the extent of outward movement of the pumping plunger depends upon the axial setting of the distributor member.

The pump is intended to deliver fuel at high pressure to the injection nozzles of an internal combustion engine and with such pumps a problem arises if air is allowed to flow into the plunger bore and the passages connected thereto. The drawing in of such air can occur if for example the fuel tank associated with the fuel system of which the pump forms part, is allowed to run dry. If the volume of air is sufficient it is possible that the inward movement of the pumping plunger may not develop sufficient pressure to displace fuel through the outlet ports, the air merely being compressed during the inward movement of the plunger and then expanding as the plunger is allowed to move outwardly.

Venting arrangements for such pumps are known in the art but such arrangements as are known generally require an operator to open a valve and the venting is usually achieved during the inward movement of the plunger. The need for intervention on the part of the operator is not considered acceptable. Accordingly it is the object of the present invention to provide a pump of the kind specified in a form in which venting of the air is achieved automatically.

According to the invention a pump of the kind specified includes means for displacing the distributor member axially to a position in which an excess of fuel will be supplied by the pump for engine starting purposes and at least one vent port formed in the body part and opening onto the periphery of the distributor member at a position to register with said delivery groove when the pumping plunger is allowed to move outwardly by the cam means.

An example of an injection pump in accordance with the invention will now be described with reference to the accompanying drawing which is diagrammatic in nature showing the pump in sectional side elevation.

Referring to the drawing the pump comprises a body part 10 in which is fixed a sleeve 11. Rotatably mounted within the sleeve is a distributor member 12, the distributor member also being axially movable within the sleeve. The distributor member projects from the sleeve and has an enlarged portion 13 in which is formed a diametrically disposed plunger bore 14. Located within the plunger bore is a pair of pumping plungers 15 which at their outer ends engage cam followers each of which comprises a shoe 16 and a roller 17. The rollers 17 engage the internal peripheral surface of an annular cam ring 17A, the cam ring having internal cam lobes formed thereon whereby as the distributor member rotates, inward movement will be imparted to the plungers.

The distributor member is driven in timed relationship with the associated engine and for this purpose there is provided a drive shaft 18. Integrally formed with the drive shaft 18 is an annular head 19 which defines a pair of slots 20. The head 19 extends about the enlarged portion of the distributor member 13 and the latter is provided with a pair of drive plates 21 which are positioned on opposite sides of the cam followers, the drive plates locating in the slots 20 so as to couple the distributor member to the drive shaft but at the same time, permitting relative axial movement of the distributor member and drive shaft. The internal surface of head 19 is flared outwardly to define a stop surface 22 with which can engage stop surfaces 23 which are defined on the side faces of the shoes 16.

The distributor member is biased by a coiled compression spring 24 which is located between the distributor member and the drive shaft. The distributor member is movable in the opposite direction that is to say against the action of the spring 24, by means of fluid pressure supplied to a chamber 25 defined in the body part 10 but into which extends the end face of the distributor member. Fuel under pressure can be supplied to the chamber 25 by way of a valve 26 from a low pressure pump which may be driven by the drive shaft. The pressure in the space 25 is controlled by a sleeve 27 which is axially adjustable within the body part 10 and which in use, is connected to a governor mechanism 27A. The sleeve controls the opening of a control port 28 and the arrangement is such that as the sleeve 27 is moved in one direction, the port 28 will either be uncovered or completely covered so as to cause a reduction or an increase respectively in the pressure in the chamber 25, the variation in pressure causing movement of the distributor member in the direction of movement of the sleeve 27.

The sleeve 27 is adjusted axially by a governor mechanism 27A. The governor mechanism may be a mechanical type of governor in which a governor spring is provided, the force exerted by which can be adjusted by means of an operator-controlled member. The force exerted by the spring is opposed by the action of governor weights which are rotated in synchronism with the drive shaft 18 and the weights bear against a carrier which is coupled to the sleeve 27. The sleeve, therefore, will move in the direction to reduce the amount of fuel supplied to the engine as the engine speed increases and, of course, will be moved in the opposite direction to increase the amount of fuel supplied to the engine if the operator-controlled member is moved to increase the force exerted by the spring. Alternatively, the governor mechanism 27A may be of an electrical nature responsive to engine operating parameters, in particular the speed of the engine and desired operating parameters, namely, the setting of the throttle pedal of the vehicle which is powered by the engine. The sleeve, of course, functions by controlling the pressure in the chamber 25, pressure being supplied to the chamber from a low-pressure pump by way of the valve 26, and the sleeve together with the control port 28 constitute an orifice through which the fuel under pressure in the chamber can escape to a drain. The effective size of the control port 28, therefore, determines the pressure in the chamber 25, and hence the axial setting of the distributor member. If the sleeve is moved in one direction, say towards the right as shown in the drawing, the control port 28 will be partially uncovered so as to reduce the pressure in the chamber 25, thereby allowing the spring 24 to move the distributor member in the same direction as the sleeve until an equilibrium is established.

The bore 14 communicates with a longitudinal passage 29 formed in the distributor member this passage communicating with axially spaced grooves 30, 31 formed on the periphery of the distributor member and connected to the passage 29 by individual passages 30A, 31A respectively.

The groove 30 is positioned to register in turn with a plurality of fuel inlet ports 32 which are formed in the sleeve 11 and which are in permanent communication by way of a passage 33 in the body part, with a source of fuel under pressure conveniently the aforesaid low pressure pump.

The groove 31 is positioned to register with a plurality of outlet ports 34, only one of which is shown, which are connected to outlets on the body part, the outlets in use being connected to the injection of the engine respectively.

In the normal operation of the pump, the groove 31 is brought into communication with an outlet port 34 just prior to the plungers being moved inwardly by the cam lobes. During the inward movement of the plungers fuel is displaced from the bore 14 to the particular outlet and hence to a combustion chamber of the associated engine. As the distributor member continues to rotate the groove 31 is moved out of register with the port 34 and the groove 30 moves into register with an inlet port 32. Fuel can now be supplied to the bore 14 to effect outward movement of the plungers 15. Such outward movement of the plungers 15 also causes outward movement of the shoes 16 and rollers 17 and the limit of movement is obtained when the stop surfaces 23 engage the surface 22. As the distributor member continues to rotate the groove 30 will move out of register with the inlet port 32 and the groove 31 will move into register with the next outlet 34. Thereafter the cycle of operations is repeated with fuel being supplied to the engine combustion spaces in turn. The amount of fuel which is supplied to the engine at each delivery stroke of the plungers is determined by the axial setting of the distributor member and as previously described this is controlled by adjusting the axial setting of the sleeve 27.

If air is allowed to enter the bore 14 and the passages connected therewith it is possible for the delivery of fuel to cease since the injection nozzles of the engine which are connected to the outlets incorporate valves which are biased by strong springs. If air is present within the bore 14 and the associated passages, there may be insufficient pressure developed during the inward movement of the plungers to cause displacement of fuel through the nozzles. It is therefore necessary to provide some mechanism whereby the air may be vented at some time during the operation of the pump. Because in the normal use of the pump very high fuel pressures are developed, it is undesirable that venting should take place during inward movement of the plungers and furthermore, it is not necessary or desirable for venting to take place during normal operation of the engine. It is therefore arranged for venting to take place only when the pump is set to deliver an excess of fuel for starting purposes.

The distributor member is shown in the drawing in the excess fuel position that is to say when the plungers can move outwardly their maximum extent. In this situation it is arranged that the groove 31 can communicate with one but preferably a plurality as shown of vent ports 35 which are formed in the sleeve and which communicate with the interior of the body part. The vent ports 35 are positioned so that registration of the groove 31 with one of the vent ports takes place during the first part of the filling cycle that is to say when the groove 30 is in communication with an inlet port 32. It will noted that the inner ends of the vent ports are of a restricted size and the arrangement is such that following delivery of fuel the groove 31 will move into register with one of the vent ports 35 and the groove 30 into register with one of the inlet ports 32. Fuel can now flow from the inlet port 32 and any air which is contained in the passages 30A and 31A together with some of the air which is contained in the passage 29, will flow towards and through the vent port 35 and to the interior of the body part from which it can be vented back to the fuel tank. It is arranged however that as the distributor member rotates the groove 31 moves out of register with the vent port 35 while communication between the groove 30 and the inlet port is maintained so that following the initial flow of air and some fuel, through the vent port, this flow will cease and fuel will then flow into the passage 29 and the bore 14 to displace the plungers outwardly. It is found that by adopting the construction as described above air will gradually be vented from the bore 14 and the passages communicating therewith although it is appreciated that several cycles may be required before full venting has been achieved. Moreover, as soon as the associated engine starts the governor mechanism 27A which is connected to the sleeve 27 will move the latter towards the left to reduce the amount of fuel which is supplied to the associated engine and this movement will prevent the groove 31 communicating with the vent ports 35 so that venting as described can only take place when the pump is set to a position to deliver excess of fuel for engine starting purposes.

I claim:

1. A liquid fuel injection pump comprising a body part, a rotary distributor member mounted in the body part and axially movable therein, a bore formed in the distributor member and a pumping plunger therein, cam means for imparting inward movement to the pumping plunger as the distributor member rotates, a delivery groove communicating with said bore, said delivery groove being formed in the periphery of the distributor member and being arranged to register in turn with outlet ports formed in the body part during successive delivery strokes of the pumping plunger, means for feeding fuel to said bore to effect outward movement of the pumping plunger, stop means for limiting the outward movement of the pumping plunger, said stop means being arranged so that the extent of outward movement of the pumping plunger depends upon the axial setting of the distributor member, means for displacing the distributor member axially to a position in which an excess of fuel will be supplied by the pump for engine starting purposes and at least one vent port formed in the body part and opening onto the periphery of the distributor member at a position to register with said delivery groove when the pumping plunger is allowed to move outwardly by the cam means.

2. A pump according to claim 1 in which said vent port is restricted.

3. A pump according to claim 2 in which said means for feeding fuel comprises a further groove formed on the periphery of the distributor member, said further groove being in communication with said bore, and a plurality of inlet ports formed in the body part and with which said further groove registers in turn as the distributor member rotates, a fuel supply passage connected to said inlet ports and said first mentioned groove registering with a vent port only during the initial period of registration of said further groove with an inlet port.

* * * * *